United States Patent [19]

Kunst

[11] Patent Number: 4,938,405

[45] Date of Patent: Jul. 3, 1990

[54] TRACTOR DRIVE FOR AN OFFICE MACHINE

[75] Inventor: Detlef Kunst, Horsten, Fed. Rep. of Germany

[73] Assignee: AEG Olympia Office GmbH, Wilhelmshaven, Fed. Rep. of Germany

[21] Appl. No.: 419,668

[22] Filed: Oct. 11, 1989

[30] Foreign Application Priority Data

Oct. 11, 1988 [DE] Fed. Rep. of Germany ..... 3834563

[51] Int. Cl.[5] ..... B65H 20/22

[52] U.S. Cl. ..... 226/74; 400/616.1; 400/616.2

[58] Field of Search ..... 226/74, 75; 400/616.1, 400/616.2

[56] References Cited

U.S. PATENT DOCUMENTS

| | | | |
|---|---|---|---|
| 4,199,091 | 4/1980 | Hubbard | 226/74 |
| 4,735,352 | 4/1988 | Ueno et al. | 226/74 |
| 4,780,013 | 10/1988 | Sakai | 226/74 X |
| 4,789,088 | 12/1988 | Unuma et al. | 226/74 |
| 4,790,467 | 12/1988 | Rex et al. | 226/74 |
| 4,819,849 | 4/1989 | Seitz | 226/74 |

*Primary Examiner*—Stuart S. Levy
*Assistant Examiner*—Paul Thomas Bowen
*Attorney, Agent, or Firm*—Spencer & Frank

[57] ABSTRACT

A tractor drive for feeding continuous paper in an office machine has a drive shaft provided with an axially extending groove; a tractor housing; a drive wheel rotatably supported in the tractor housing; a transport member connected to the drive wheel to be driven thereby and arranged to project into marginal perforations of the paper for transmitting a feeding force thereto; a bearing sleeve affixed to the drive wheel and coaxially mounted on the drive shaft; a feather key carried by the bearing sleeve; and an actuating member operatively connected to the feather key. The actuating member has a clamping position in which it presses the feather key into a clamping contact with the bottom of the drive shaft groove, whereby the tractor (formed of the tractor housing, the drive wheel, the transport member and the bearing sleeve) is axially immobilized relative to the drive shaft. The actuating member has a releasing position in which it allows the feather key to be released from the groove bottom, whereby the tractor is axially shiftable on and relative to the drive shaft.

14 Claims, 1 Drawing Sheet

Fig. 1
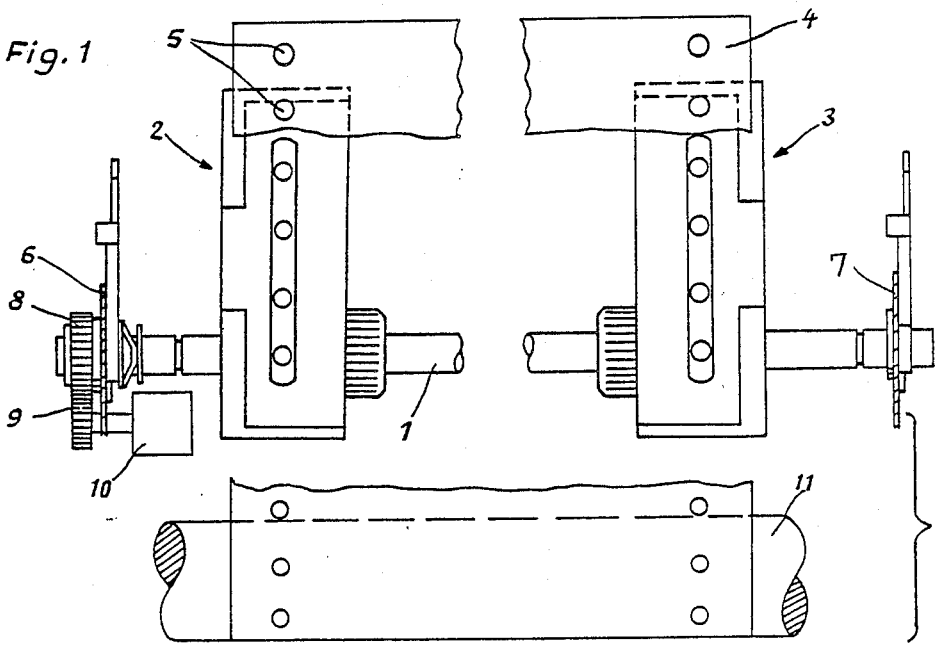
Fig. 3
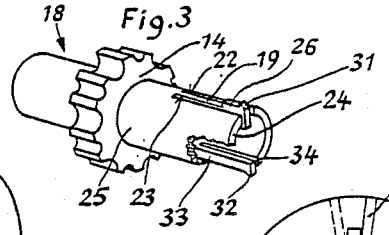
Fig. 2
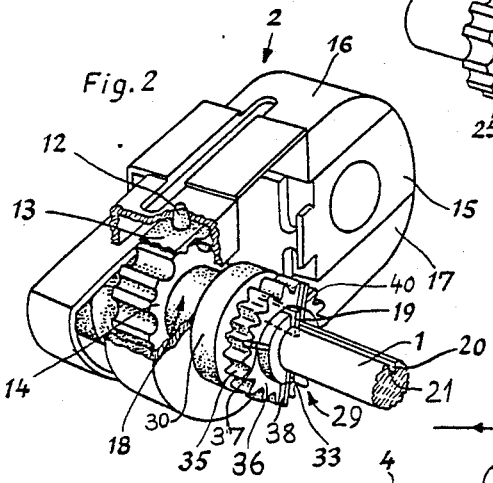
Fig. 4
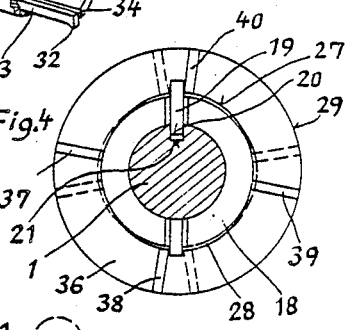
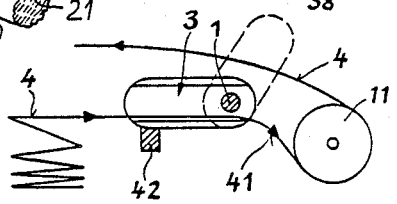
Fig. 5

TRACTOR DRIVE FOR AN OFFICE MACHINE

CROSS REFERENCE TO RELATED APPLICATION

This application claims the priority of Federal Republic of Germany Application No. P 38 34 563.3 filed Oct. 11, 1988, which is incorporated herein by reference.

BACKGROUND OF THE INVENTION

This invention relates to a tractor drive for continuous paper having perforated edges for use in typewriters or similar office machines. The tractor drive is of the type which has tractor members which are rotated by a drive shaft and which are shiftable axially, that is, parallel to the width of the continuous paper and can be immobilized in a desired position to thus accurately align the respective toothed transporting (tractor) belts, each driven by a toothed gear, with the marginal holes provided in the continuous paper.

In conventional continuous paper feeders or continuous paper transporting devices for information processing machines it is known to drive an endless transporting belt by a toothed gear meshing with teeth on the inwardly-oriented face of the belt. The outwardly-oriented belt face has driving pins which engage in the marginal holes of the continuous paper for a continuous feed. A major difficulty encountered in these transporting devices is aligning the transporting belts and the pins accurately to mate with the marginal holes in the continuous paper.

To overcome this difficulty, according to U.S. Pat. No. 4,735,352, the two tractors are axially displaceable on a drive shaft and a guide bar and they can be immobilized in the desired axial position by tightening them to the guide bar by means of a clamping device. This tractor device which includes a drive shaft and an additional guide bar is too complex and expensive for low-cost office machines.

SUMMARY OF THE INVENTION

It is an object of the present invention to provide an improved tractor drive for typewriters or other office machines which, with simple construction, ensures reliable driving and accurate guidance and makes possible an immobilization of the tractors by a simple manipulation.

This object and others to become apparent as the specification progresses, are accomplished by the invention, according to which, briefly stated, the tractor drive for feeding continuous paper in an office machine has a drive shaft provided with an axially extending groove; a tractor housing; a drive wheel rotatably supported in the tractor housing; a transport member connected to the drive wheel to be driven thereby and arranged to project into marginal perforations of the paper for transmitting a feeding force thereto; a bearing sleeve affixed to the drive wheel and coaxially mounted on the drive shaft; a feather key carried by the bearing sleeve; and an actuating member operatively connected to the feather key. The actuating member has a clamping position in which it presses the feather key into a clamping contact with the bottom of the drive shaft groove, whereby the tractor (formed of the tractor housing, the drive wheel, the transport member and the bearing sleeve) is axially immobilized relative to the drive shaft. The actuating member has a releasing position in which it allows the feather key to be released from the groove bottom, whereby the tractor is axially shiftable on and relative to the drive shaft.

It is an advantage of the invention that due to the small number of parts involved, the tractor drive is economical to assemble particularly since a fixed guide bar of the prior art devices is no longer needed. Moreover, the continuous paper is threaded easily since the tractors are pivotal. By clamping the tractors to the drive shaft, each tractor retains its component-specific mobility (play) which enables it to adapt itself to the marginal holes in the paper. This reliably prevents uneven tension on the paper and skewing of the tractors during tightening.

BRIEF DESCRIPTION OF THE DRAWING

FIG. 1 is a top plan view of a preferred embodiment of the tractor drive according to the invention.

FIG. 2 is a perspective view of a component of the preferred embodiment.

FIG. 3 is a perspective view of another component of the preferred embodiment.

FIG. 4 is an end elevational view of the component shown in FIG. 3.

FIG. 5 is a diagrammatic representation of the operation of the preferred embodiment.

DESCRIPTION OF THE PREFERRED EMBODIMENT

FIG. 1 shows a tractor drive for feeding continuous paper 4 provided with edge perforations 5 in typewriters or similar office machines. The tractor drive includes tractors 2 and 3 which are driven by a drive shaft 1. Each tractor 2, 3 has a transporting belt 13 provided with pins 12 and driven by a drive wheel 14. Each tractor 2, 3 is axially displaceable along the drive shaft 1 for aligning the transport belt 13 with the perforation 5. The drive shaft 1 is rotatably mounted at its ends in side walls 6 and 7 and is provided with a toothed wheel 8 which meshes with a drive pinion 9 of a drive motor 10.

Also referring to FIG. 2, the housing of each tractor 2 and 3 is composed of a centrally separable basic body 15 having a pivotal pressure plate 16 and 17 on its upper and lower side, respectively. Pressure plates 16 and 17 conventionally ensure that the edge perforations 5 of the continuous paper 4 always remain in engagement with the pins 12 of the transport belt 13.

Each tractor housing 15 accommodates a throughgoing bearing sleeve 18 allowing each tractor 2 and 3 t be displaced on and being pivotal about the drive shaft 1. To the bearing sleeve 18 there is affixed a toothed drive wheel 14 which meshes with teeth provided on the transport belt 13 at its face opposite the face carrying the pins 12. The bearing sleeve 18 further has a feather key 19 which projects into an axial groove 20 provided in the drive shaft 1. For axially immobilizing the tractor on a selected location along the drive shaft 1, the feather key 19 can be pressed by a manually rotatable clamping ring 29 against the bottom face 21 of the groove 20. The feather key 19 is disposed in the free end of the bearing sleeve 18 where the feather key 19 projects from the tractor housing 15 and, as shown in FIG. 3, is formed by providing two parallel-spaced, unilaterally open slots 22, 23 extending longitudinally in the wall 24 of the bearing sleeve 18. The free end of the feather key 19 in each tractor 2, 3 is provided with a clamping face 26 which is situated radially beyond the cylindrical surface 25 of the bearing sleeve 18 and is in engagement with the manually actuatable clamping ring 29 or, more precisely, with an inner circumferential clamping face 27 defining an eccentric and/or unround aperture (hole) 28 in the clamping ring 29. In the one end position of the clamping ring 29 the feather key 19 is urged against the bottom face 21 of the groove 20 by the clamping face 27, while in the other, approximately 90° offset end position of the clamping ring 29, the feather key 19 is allowed—by its own resiliency—to lift off the bottom face 21 of the groove 20, whereby the respective tractor 2 or 3 is axially freely displaceable on the drive shaft 1.

For preventing the clamping ring 29 and a spacer ring 30 inserted on the drive shaft 1 between the clamping ring 29 and the exterior of the housing 15 from shifting axially relative to the bearing sleeve 18, the latter has two diametrically opposite retaining lugs 31 and 32 which cooperate with a radial front face 36 of the clamping ring 29. The lug 31 is disposed at the free end of the feather key 19 and projects beyond the clamping face 26, while the lug 32 is formed on the free end of a resilient web 33 which is a resilient, strip-like part of the wall 24 of the bearing sleeve 18. The web 33 is defined between unilaterally open slots 34 in the wall 24.

To provide for a firm manual grasp of the clamping ring 29 for effecting, by its rotation, an axial immobilization or release of the respective tractor 2 or 3, the clamping ring 29 is provided with knurling or teeth 35 on its outer circumference. The two end positions of the clamping ring 29 are defined by four 90° offset and radially oriented stops 37, 38, 39, 40 which are formed on the front face 36 of the clamping ring 29 and which are brought into abutment with lateral faces of the lugs 31, 32 during rotation of the clamping ring 29.

Tractors 2 and 3 are thus composed of few individual parts. By simply rotating the clamping ring 29 of the respective tractor 2 or 3 by 90°, the feather key 19 is brought into or out of contact with the bottom face 21 of the groove 20 in the drive shaft 1, thus permitting simple and rapid axial adjustments of the tractors 2 and 3.

As shown schematically in FIG. 5, the tractor drive for continuous paper provided with edge perforations does not require an additional guide bar for clamping and axially guiding the tractors. As the continuous paper 4 is transported by the tractor drive in the direction of the arrow 41, the rotation of the drive shaft 1 exerts a counterclockwise torque on the tractor housing 15, causing the tractor housing 15 to be pressed against a stop 42 which is fixed to the machine frame. To ensure an accurate paper transport, the pressure roller (platen) 11 is driven in such a manner relative to the tractor drive that no paper slippage on the platen 11 will occur.

It will be understood that the above description of the present invention is susceptible to various modifications, changes and adaptations, and the same are intend to be comprehended within the meaning and range of equivalents of the appended claims.

What is claimed is:

1. A tractor drive for feeding continuous paper in an office machine, comprising (a) a drive shaft supported for rotation about a longitudinal drive shaft axis; said drive shaft having an axially extending groove defined by side walls and a bottom formed in the drive shaft;

(b) a tractor housing;

(c) a drive wheel rotatably supported in the tractor housing;

(d) a transport member connected to said drive wheel to be driven by said drive wheel; said transport member having means for projecting into marginal perforations of the paper for transmitting a feeding force thereto;

(e) a bearing sleeve affixed to said drive wheel and coaxially mounted on said drive shaft;

(f) a feather key carried by said bearing sleeve and being in alignment with said groove; and (g) an actuating member operatively connected to said feather key and having a clamping position and a releasing position; in said clamping position said actuating member presses said feather key into a clamping contact with said bottom, whereby said tractor housing, said drive wheel, said transport member and said bearing sleeve are axially immobilized as a unit relative to said drive shaft; in said releasing position said actuating member allows said feather key to be released from said bottom, whereby said tractor housing, said drive wheel, said transport member and said bearing sleeve are, as a unit, axially shiftable on and relative to said drive shaft.

2. A tractor drive as defined in claim 1, wherein said bearing sleeve has a terminal wall portion projecting axially beyond said tractor housing and having a free end; further wherein said feather key is defined by a part of said terminal wall portion situated between two parallel axial throughgoing slots provided in said terminal wall portion and being open at said free end.

3. A tractor drive as defined in claim 1, wherein said transport member includes an endless transport belt supported in the housing and transport pins carried on said endless transport belt.

4. A tractor drive as defined in claim 1, wherein said feather key has a clamping face; further wherein said actuating member is a clamping ring mounted on said bearing sleeve and being rotatable with respect thereto into said clamping and releasing positions; further wherein said clamping ring has an opening through which said bearing sleeve passes; said opening being bounded by an eccentric clamping face cooperating with the clamping face of the feather key; in said clamping position said eccentric clamping face presses on the clamping face of said feather key, depressing said feather key into said clamping contact with said bottom.

5. A tractor drive as defined in claim 4, wherein said clamping and releasing positions of said clamping ring are 90° offset relative to one another.

6. A tractor drive as defined in claim 4, wherein said clamping ring has a knurled external circumferential surface.

7. A tractor drive as defined in claim 4, further wherein said bearing sleeve has a terminal wall portion projecting axially beyond said tractor housing and having a free end; further wherein said feather key is defined by a part of said terminal wall portion situated between two parallel axial throughgoing slots provided in said terminal wall portion and being open at said free end; wherein said bearing sleeve has diametrically oppositely located first and second retaining lugs projecting radially beyond an outer cylindrical surface of said terminal wall portion; said first and second retaining lugs being arranged to abut a part of said clamping ring for preventing an axial displacement between said clamping ring and said bearing sleeve.

8. A tractor drive as defined in claim 7, wherein said part of said clamping ring is constituted by a radial end face of said clamping ring; said radial end face being situated adjacent said free end.

9. A tractor drive as defined in claim 7, further comprising a spacer ring mounted on said bearing sleeve between said tractor housing and said clamping ring.

10. A tractor drive as defined in claim 7, wherein said part of said clamping ring is a radial end face thereof.

11. A tractor drive as defined in claim 10, further comprising four stops formed on said radial end face at 90° offset relative to one another; said stops being situated such as to abut said retaining lugs for limiting rotary motions of said clamping ring.

12. A tractor drive as defined in claim 7, wherein said first retaining lug is formed on said feather key.

13. A tractor drive as defined in claim 12, wherein said terminal wall portion of said bearing sleeve has a radially resilient web portion carrying said second retaining lug.

14. A tractor drive as defined in claim 13, wherein said radially resilient web portion is defined by a part of said terminal wall portion situated between two additional parallel axial throughgoing slots provided in said terminal wall portion and being open at said free end.

* * * * *